United States Patent [19]

Ricks

[11] Patent Number: 4,759,139

[45] Date of Patent: Jul. 26, 1988

[54] BABY BOTTLE IDENTIFICATION COLLAR

[76] Inventor: M. David Ricks, 3341 Gettysburg Ave. North, New Hope, Minn. 55427

[21] Appl. No.: 43,084

[22] Filed: Apr. 27, 1987

[51] Int. Cl.[4] ..... G09F 3/08

[52] U.S. Cl. ..... 40/638; 40/310; 40/666; 215/11.1

[58] Field of Search ..... 40/21 B, 21 R, 310, 40/311; 215/11.1, 11.4, 100 R, 365, 230

[56] References Cited

U.S. PATENT DOCUMENTS

| | | | |
|---|---|---|---|
| 1,554,191 | 9/1925 | Alexander | 40/310 |
| 1,721,644 | 7/1929 | Sovatkin | 215/100 R |
| 2,201,205 | 5/1940 | Samburg | 40/311 X |
| 2,250,666 | 7/1941 | Godefroy | 40/21 B X |
| 3,990,596 | 11/1976 | Hoftman | 215/11.1 |
| 4,548,157 | 10/1985 | Hevoyan | 215/11.1 X |

FOREIGN PATENT DOCUMENTS

| | | | |
|---|---|---|---|
| 1030209 | 5/1958 | Fed. Rep. of Germany | 215/100 R |
| 10827 | 12/1927 | United Kingdom | 40/21 B |

*Primary Examiner*—Leonard E. Smith

*Attorney, Agent, or Firm*—Foley & Lardner

[57] ABSTRACT

A removable identification collar for baby bottles. The collar has a planar portion having a wall defining a hole therethrough. The collar is placed over the neck of a bottle with the neck passing through the hole and the collar is maintained on the bottle by a standard nipple cap. The collar has a flange connected to the planar portion whereby a portion thereof is adapted to receive a gummed label. A raised ridge conforming closely to the periphery of a gummed label is provided to prevent infants from readily removing the label.

18 Claims, 1 Drawing Sheet

BABY BOTTLE IDENTIFICATION COLLAR

BACKGROUND OF THE INVENTION

The present invention relates to an identification collar for an infant's bottle.

With the prevalent use of day care centers, a need has been created for a means of quickly and easily associating a bottle with a particular infant, and distinguishing the bottles of respective infants.

In the past, it has been a common practice to write the infant's name on a piece of masking tape, and affixing the tape to the body of the bottle. Such practice, however, has been disadvantageous in a number of respects. Infants often are able to remove the masking tape from the bottle. Further, the tape must be removed to properly cleanse the bottle, and often left a sticky residue.

SUMMARY OF THE INVENTION

The present invention provides a removable identification collar for baby bottles. The collar is maintained on the bottle by a standard nipple cap. A portion of the flange of the collar is adapted to receive a gummed label. A raised ridge conforming closely to the perimeter of a gummed label is provided to prevent infants from readily removing the label.

BRIEF DESCRIPTION OF THE DRAWING

A preferred exemplary embodiment will hereinafter be described with reference to the appended drawing, wherein like numerals denote like elements and.

DETAILED DESCRIPTION OF A PREFERRED EXEMPLARY EMBODIMENT

Figure 1:
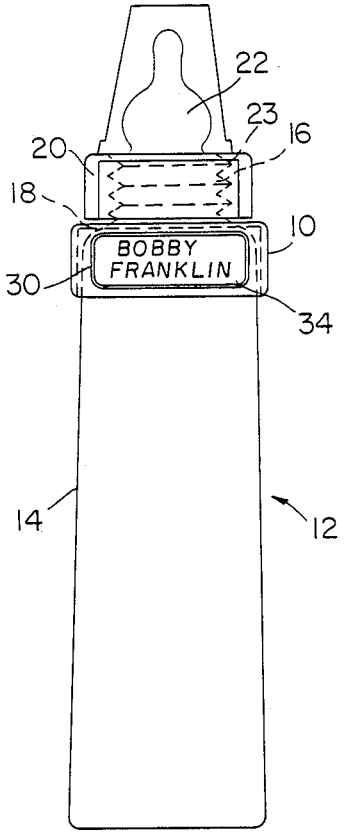
FIG. 1 is a side elevation view of a bottle bearing an identification collar in accordance with the present invention.

Referring now to FIG. 1, identification collar 10 in accordance with the present invention is disposed on a conventional baby bottle 12. Baby bottle 12 includes a body 14 and a generally cylindrical neck portion 16 which merges with body 14 at a shoulder 18. Neck 16 is suitably threaded, and cooperates with a correspondingly threaded standard overfitting cap 20. Cap 20 suitably maintains a nipple 22 in liquid-tight relation with the top of neck 16. As is well known in the art, nipple 22 typically extends through an aperture in cap 20, and an integral flange portion 23. Nipple flange 23 is maintained under cap 20 and compressed by the interaction of the threads of neck 16 and cap 20 to provide a seal.

Referring now to FIGS. 1–4, collar 10 includes a generally planar top portion 24, with a central aperture 26, and a peripheral flange 28 depending from the perimeter of top portion 24. A protruding ridge 30 defines a closed area 32 on the exterior face of flange 28 adapted to closely receive a gummed label 34 (FIG. 4) of a shape and dimensions closely conforming to those of area 32.

Figure 2:
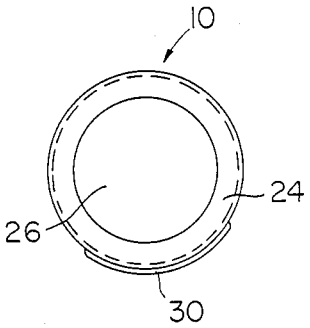
FIG. 2 is a top view of the identification collar in accordance with the present invention.
Figure 3:
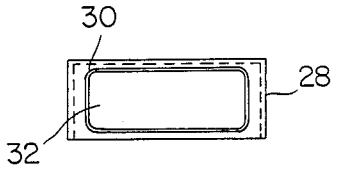
FIG. 3 is a side view of the identification collar of FIG. 2.
Figure 4:
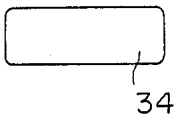
FIG. 4 is a side view of a gummed label employed with the collar of FIG. 2.

With particular reference to FIGS. 1 and 2, identification collar 10 is installed on bottle 12 by removing cap 20 and disposing collar 10 on bottle 12 with bottle neck 16 extending through aperture 26 and with at least a portion of shoulder 18 extending into the cavity defined by collar flange 28. Cap 20 is then reinstalled, threaded on neck 16, retaining collar 10 on bottle 12.

Collar 10 is designed to be received about neck 16, and maintained on the bottle by cap 20, without interfering with the seal betwen nipple 22 and the top of neck 16. Top portion 24 is suitably sufficiently large to permit the interior cavity formed within flange 28 to receive at least a portion of the shoulder of most standard size baby bottles. Top portion 24 suitably manifests a circular perimeter having a diameter of on the order of two inches. Flange 28 is suitably approximately 13/16ths inch in length. Similarly, aperture 26 is sufficiently large to receive therethrough the necks 16 of most standard size bottles. while at the same time being of lesser dimensions than the periphery of standard bottle cap 20. Aperture 26 is suitably circular with a $\frac{3}{4}$ inch diameter.

However, to ensure that cap 20 may be threaded onto neck 16 sufficiently to create the necessary seal between the flange 23 of nipple 22 and top of neck 16, collar 10 must extend only a relatively limited extent along neck 16. This is accommodated by making collar 10 sufficiently large to overfit shoulder 18 and/or body 12, receiving those portions of bottle 12 within the internal cavity, as noted above, and by limiting the thickness of top portion 24. It has been found that a thickness of 1/16th inch is accommodated by most standard bottles and caps, while still permitting the cap to be fully threaded onto neck 16 and create the seal between nipple flange 23 and the top of the bottle neck 16.

Collar 10 and label 34 provide a convenient mechanism for identifying bottle 12, not easily tampered with by infants, and facilitating frequent sterilization of bottle 17. In practice, the baby's name is written on label 34, and label 34 is applied to area 32 on flange 28. Collars 10 may be provided in a plurality of different colors to provide a further discriminant. Label 34 is suitably a commercially available gummed label, generally rectangular in shape, $1\frac{1}{2}$ inches by $\frac{5}{8}$ inch, with rounded corners. Gummed label 34 label conforms in peripheral shape to area 32 of flange 28, such that, when disposed in area 32, the edge of label 34 butts against raised ridge 30. Ridge 30 tends to impede removal of label 34 by scraping actions, rendering removal of label 34 difficult for infants. Conversely, labels 34 can be readily removed by adults, and tend not to leave a sticky residue on area 32 when removed.

Collar 10 is suitably made of a rigid plastic, similar to the plastic conventionally used to make cap 20. Collar 10 is, thus, non-toxic and dishwasher safe and, with label 34 removed, can be sterilized along with bottle 12, nipple 22, and cap 20. In practice, however, collar 10 is most often removed from bottle 12 when the bottle is washed, and thereafter replaced on the bottle, thus facilitating frequent sterilization of bottle 17.

Collar 10 is suitably rotatable with respect to bottle 12, and relatively free-spinning. This permits the collar to be used as a toy by older infants. Likewise, label 34 can be positioned by an adult to act as an attention referent for smaller infants or, conversely, can be turned to prevent the label from distracting the infant while being bottle fed.

It will be understood that the above description is of a preferred exemplary embodiment of the present invention, and the invention is not limited to the specific forms shown. For example, while in the preferred embodiment the periphery of top portion 24 is circular, and flange 28 essentially cylindrical, the periphery of top portion 24 could be polygonal, and flange 28 shaped accordingly. Similarly, while employing ridge 30 to impede removal of the label by an infant is preferred, area 32 can be recessed in the wall of flange 28. The perimeter of label 34, when applied to area 32, would butt against the side wall of the recess, and the side wall would operate as an impediment to removal of the label by an infant. These and other modifications may be made in the design and arrangement of the elements within the scope of the invention, as expressed in the appended claims.

I claim:

1. An identification collar for an infant bottle, said bottle having a body, a generally cylindrical neck portion of lesser cross-section than said body in the proximity of said neck, and a shoulder interconnecting said neck and said body, said neck cooperating with a removal overfitting dispenser cap, said collar comprising:

a generally planar portion including an aperture, said aperture being of predetermined dimensions sufficient to receive said neck therethrough; and a peripheral flange, depending from said generally planar portion and defining an interior cavity, said cavity being adapted to receive at least a portion of said shoulder when said neck is received in said aperture;

said flange including an area of predetermined shape on the face thereof adapted to receive a gummed identification label generally of said predetermined shape, and means, bounding said area of predetermined shape, for impeding removal of said label by an infant.

2. The collar of claim 1, wherein said raised ridge is generally rectangular shape.

3. The collar of claim 2, wherein said ridge bounds an area of approximately $1\frac{1}{2}$ inch by $\frac{5}{8}$ inch.

4. The collar of claim 1, where said generally planar portion is generally circular, and said peripheral flange generally cylindrical.

5. The collar of claim 4, wherein said planar portion has approximately 2 inch diameter.

6. The collar of claim 5, wherein said aperture is circular, with a diameter of approximately $\frac{3}{4}$ inch.

7. The collar of claim 1, where said means for impeding comprises a raised ridge disposed on the exterior face of said flange portion.

8. The collar of claim 2, wherein said generally planar portion is approximately 1/16th inch thick.

9. The collar of claim 8, where said generally planar portion is generally circular, and said peripheral flange generally cylindrical.

10. The collar of claim 9, wherein said planar portion has approximately 2 inch diameter.

11. The collar of claim 10, wherein said aperture is circular, with a diameter of approximately $\frac{3}{4}$ inch.

12. The collar of claim 1, wherein said generally planar portion is approximately 1/16th inch thick.

13. The collar of claim 12, where said generally planar portion is generally circular, and said peripheral flange generally cylindrical.

14. The collar of claim 13, wherein said planar portion has approximately 2 inch diameter.

15. The collar of claim 14, wherein said aperture is circular, with a diameter of approximately $\frac{3}{4}$ inch.

16. The collar of claim 15, wherein said flange depends from said planar portion for a distance of approximately 13/16ths inch.

17. An infant bottle comprising:

a body for maintaining a liquid in the interior thereof;

a generally cylindrical neck portion of lesser cross section than said body in the proximity of said neck;

a shoulder interconnecting said neck and said body;

a dispenser cap, adapted to be removably received over said neck; and an identification collar, said collar comprising:

a generally planar top portion having an aperture therein, and a peripheral flange, depending from said generally planar portion and defining an interior cavity;

said collar being disposed on said bottle with said neck disposed within said aperture, and at least a portion of said shoulder received within said interior cavity;

said flange including an area of predetermined shape on the face thereof adapted to receive a gummed identification label generally of said predetermined shape, and means, bounding said area of predetermined shape, for impeding removal of said label by an infant.

18. The collar of claim 17, where said means for impeding comprises a raised ridge disposed on the exterior face of said flange portion.

* * * * *